US005561015A

United States Patent [19]

Yoshida et al.

[11] Patent Number: 5,561,015

[45] Date of Patent: Oct. 1, 1996

[54] ELECTROPHOTOGRAPHIC PHOTOSENSITIVE MEMBER HAVING INTERLAYER ON CLEANED SUPPORT AND PROCESS FOR PRODUCTION THEREOF

[75] Inventors: Akira Yoshida, Sagamihara; Mutsuo Otaka, Ryugasaki; Koichi Sawada, Toride; Yoichi Kawamorita, Yokohama; Hideo Maruoka, Toride; Takao Soma, Sagamihara, all of Japan

[73] Assignee: Canon Kabushiki Kaisha, Tokyo, Japan

[21] Appl. No.: 272,656

[22] Filed: Jul. 11, 1994

Related U.S. Application Data

[63] Continuation of Ser. No. 868,104, Apr. 14, 1992, abandoned.

[30] Foreign Application Priority Data

| | | | |
|---|---|---|---|
| Apr. 19, 1991 | [JP] | Japan | 3-113716 |
| May 20, 1991 | [JP] | Japan | 3-142632 |
| Mar. 31, 1992 | [JP] | Japan | 4-104049 |

[51] Int. Cl.[6] ..... G03G 5/10

[52] U.S. Cl. ..... 430/58; 430/62

[58] Field of Search ..... 430/60, 62, 56

[56] References Cited

U.S. PATENT DOCUMENTS

| | | | |
|---|---|---|---|
| 4,123,267 | 10/1978 | Dorer | 430/65 |
| 4,518,669 | 5/1985 | Yashiki | 430/57 |
| 4,657,835 | 4/1987 | Yashiki | 430/60 |
| 5,069,992 | 12/1991 | Tachikawa et al. | 430/49 |
| 5,314,780 | 5/1994 | Takei et al. | 430/128 |

FOREIGN PATENT DOCUMENTS

| | | |
|---|---|---|
| 58-14841 | 1/1983 | Japan . |
| 1-130159 | 5/1989 | Japan . |
| 1545890 | 5/1979 | United Kingdom . |

OTHER PUBLICATIONS

Patent Abstract of Japan, vol. 13, No. 180 (P–864) [3528] Apr. 27, 1989.

Patent Abstract of Japan, vol. 13, No. 375 (P–921) [3723] Aug. 21, 1989.

Patent Abstract of Japan, vol. 13, No. 384 (C–629) [3732] Aug. 24, 1989.

*Primary Examiner*—John Goodrow

*Attorney, Agent, or Firm*—Fitzpatrick, Cella, Harper & Scinto

[57] ABSTRACT

The present invention provides an electrophotographic photosensitive member which comprises an electroconductive support, an interlayer, and a photosensitive layer, wherein the electroconductive support is previously cleaned with a solution mainly composed of water, end the interlayer contains an electroconductive substance.

The product is excellent in the electrophotographic properties and the process of making is not harmful to the human health and does not pollute the environment.

64 Claims, No Drawings

ELECTROPHOTOGRAPHIC PHOTOSENSITIVE MEMBER HAVING INTERLAYER ON CLEANED SUPPORT AND PROCESS FOR PRODUCTION THEREOF

This application is a continuation of application Ser. No. 07/868,104, filed Apr. 14, 1992, now abandoned.

BACKGROUND OF THE INVENTION

1. Field of the Invention

The present invention relates to an electrophotographic photosensitive member and a process for producing the electrophotographic photosensitive member, more particularly to an electrophotographic photosensitive member which has an electroconductive support having been cleaned by a specified method and an interlayer, and a process for making it.

2. Related Background Art

Generally, an electrophotographic photosensitive member comprises an electroconductive support and a photosensitive layer formed thereon. The material useful for the electroconductive support includes metals such as aluminum, copper, iron, brass, and stainless steel, and alloys thereof. Among them, aluminum is most widely used because of its high workability and high dimensional stability. The electroconductive support is usually worked by rolling, casting, machining, or the like. The worked surface of the support,is usually contaminated with oily materials such as working oil, machining oil, and rust preventive oil used during working (kerosene, polybutene, etc.), or shavings of the working, dust in the air, human fingerprint, etc.

If a photosensitive layer is formed on the support having such conditions, the resulting layer cannot be uniform and does not work as a photosensitive member, or even if it works it gives low quality images when used in an electrophotographic apparatus (copying machines, laser beam printers, LED printers, liquid crystal shutter printers, and facsimile machines).

Accordingly, complete cleaning of the support is indispensable in the production of electrophotographic photosensitive members.

Heretofore, supports for electrophotographic photosensitive members are cleaned using a halogenated hydrocarbon such as trichloroethylene, trichloroethane, dichloromethane, and carbon tetrachloride for their degreasing property, noncombustibility, and quick drying property. Acids and alkalis are also known to be useful for cleaning. Further, as a dry cleaning methods, it is known to irradiate with ozone, UV rays, or the like to decompose adhered contaminants.

The organic solvents, however, including the halogenated hydrocarbon solvents, may adversely affect not only human bodies but also the global environment. The use of an acid or an alkali requires a neutralization process, or may cause corrosion of the surface of the support. The ozone itself has harmful effects on human bodies. To avoid the above disadvantages, a large scale installation is necessary, requiring a large installation area and a high cost.

To solve the problems, methods for cleaning a support with water are disclosed in Japanese Laid-Open Patent Application Nos. 58-14841, and 1-130159.

In the cleaning of the support with a liquid mainly composed of water, the degree of cleaning is improved effectively by using an auxiliary agent such as a surfactant, cavitation effect of ultrasonication, high-pressure water jet from a jet nozzle, and additionally by using a brush or a blade.

When the cleaning with water, however, a non-uniform oxide film may be formed on the support surface, or the surface may be toughened, which may affect adversely the characteristics of the electrophotographic photosensitive member.

To meet the recent requirements for higher image quality, higher speed, and higher durability in electrophotography, electrophotographic photosensitive members having more satisfactory properties have been pursued.

SUMMARY OF THE INVENTION

The present invention intends to provide an electrophotographic photosensitive member having excellent electrophotographic characteristics.

The present invention also intends to provide a process not affecting the environment and human bodies for producing an excellent electrophotographic photosensitive member.

The electrophotographic photosensitive member of the present invention comprises an electroconductive support, an interlayer, and a photosensitive layer, wherein the electroconductive support has been cleaned with a solution mainly composed of water, and the interlayer contains an electroconductive substance.

The present invention also provides a process for producing an electrophotographic photosensitive member, comprising a washing process of the surface of the electroconductive support with a liquid mainly composed of water, a process of forming an interlayer on the washed support wherein the interlayer contains an electroconductive substance, and a process of forming a photosensitive layer on the interlayer.

DESCRIPTION OF THE PREFERRED EMBODIMENT

The electrophotographic photosensitive member of the present invention comprises an electroconductive support cleaned with a solution mainly composed of water, an interlayer containing an electroconductive substance, and a photosensitive layer.

The material for the electroconductive support used in the present invention includes metals such as aluminum, copper, iron, brass, and stainless steel, alloys composed of the above metals with or without other elements, materials such as paper, plastics, and ceramics coated with or vapor-deposited with the above-mentioned metal or alloy. Among them, aluminum and aluminum alloy are preferred from the factors of workability dimensional stability. The electroconductive support may be in a shape of a drum or a sheet, but the shape is not limited thereto. The surface of the electroconductive support may be worked by machining or other methods in the present invention.

The solution mainly composed of water which is used for cleaning the support in the present invention may consist only of water, or may additionally contain an auxiliary agent such as a surfactant which is mildly acidic to mildly alkaline. A solution containing from 0.1 to 20 parts by weight of a surfactant to 100 parts by weight of water is preferred in the present invention.

The water used is preferably of high purity, having specific resistivity of not less than 0.1 MΩcm.

A surfactant is a compound having a hydrophobic moiety and a hydrophilic moiety. It tends to concentrate at an interface of two substances (the support and the oil), and is effective in separating the two substances. The surfactants are classified into two groups of ionic type and nonionic type depending on the type of the hydrophilic group. The ionic type surfactants include sodium salts of aliphatic higher alcohol sulfate esters, alkyltrimethylammonium chlorides, alkyldimethyl betaine, and the like. The nonionic type surfactants include aliphatic higher alcohol-ethylene oxide adducts (polyethylene glycol alkyl ether). Any of these surfactants are effective in the present invention.

The cleaning temperature is preferably in the range of from 25 to 80° C. depending on the kind of the surfactant used.

For more effective cleaning, in addition to the immersion of the support into a water bath, a brush or a blade may be used, or high-pressure water jet from a jet nozzle or ultrasonication may be applied. The application of ultrasonication is particularly preferred.

In the present invention, the cleaning process may include a plurality of steps such as a preliminary cleaning step, a main cleaning step, a post cleaning step, and a rinsing step. Further to improve the cleaning extent, treatment with steam of pure water, immersion in a hot pure water bath, or treatment with pure water shower and hot air drying may be conducted preferably after the cleaning. The immersion in a hot pure water is particularly preferred. The electric conductivity of the pure water used is preferably not higher than 5 μS, more preferably not higher than 1 μS. The treatment temperature is preferably in the range of from 25° C. to 90° C., more preferably from 40° C. to 80° C.

By such treatment, an oxide film is formed on the surface of an electroconductive support. The oxide film characteristically improves the hole injection from the support as well as the adhesiveness of the layer provided on the support. The oxide film, however, tends to be not uniform or to cause irregularities of the surface of the support. Therefore, in the present invention, an interlayer containing an electroconductive substance is provided between the support and the photosensitive layer to prepare an electrophotographic photosensitive member having more excellent electrophotographic characteristics.

The electroconductive substance employed in the present invention includes tin oxide, indium oxide, zinc oxide, aluminum oxide, antimony oxide, titanium oxide, iron oxide, barium sulfate, barium carbonate, carbon black, aluminum, silver, copper, nickel, and the like. From among these substances, metal oxides are preferred. The electroconductive substance may be used singly or in combination of two or more thereof. When the combination of two or more of the electroconductive substances is employed, the substances may be added separately, or may be used in a form of a solid solution, or a fused solid.

The interlayer containing an electroconductive substance may contain resins, which include thermoplastic resins such as polyvinyl alcohol, gelatin, casein, rosin, cellulose, polyamides, polyacrylic acid, polyacrylates, polymaleic acid, polystyrene, polyethylene, polyvinyl chloride, polyvinyl acetate, polyvinylpyrrolidone, polyester, polycarbonate, polystyrene-maleic acid copolymer, and styrene-methyl acrylate copolymers; and thermosetting resins such as epoxy resins, urethane resins, unsaturated polyester resins, alkyd resins, acrylic-melamine resins, silicone resins, curable rubber, and phenol resins. Considering the possibility of the elution on the photosensitive layer formation on the interlayer, thermosetting resins are preferred. Phenol resins are particularly preferred which are derived by reacting a phenol with an aldehyde in the presence of alkaline catalyst to form a resol and curing the resulting resol by heat or an acid.

The phenols for forming the resol include m-cresol, o-cresol, p-cresol, 3,5-xylenol, 2,5-xylenol, 2,4-xylenol, and phenol. The aldehydes therefor include formaldehyde, furfural, and acetaldehyde. In the present invention, a reaction product of phenol with formaldehyde is preferred.

The alkaline catalyst employed in the reaction includes alkali metal hydroxides such as sodium hydroxide, lithium hydroxide, and potassium hydroxide; primary, secondary, and tertiary amines such as dimethylamine, ethylamine, methylamine, diethylamine, di-n-propylamine, isopropylamine, n-propylamine, hexamethylenetetramine, pyridine, dibenzylamine, trimethylamine, benzylamine, and triethylamine; and ammonia.

As this type of resol, available are "Priophen J-325" and "Priophen 5010" made by Dainippon Ink and Chemicals, Inc., and so forth. The phenol resins derived by curing such a resol under a desired curing conditions have an average molecular weight preferably in the range of from 350 to 20000.

The ratio of the resin to the electroconductive substance is preferably in the range of from 1:1 to 1:5. They are mixed and dispersed by means of an apparatus such as a roll mill, a ball mill, a vibrating mill, an attritor, a sand mill, a colloid mill, and the like.

The interlayer has a thickness preferably in the range of from 1 to 30 μm, more preferably from 5 to 25 μm.

In the present invention, a second interlayer is preferably provided on the aforementioned interlayer to order to prevent the penetration of the photosensitive layer into the above interlayer, to improve the adhesiveness of the photosensitive layer to the interlayer, and to stabilize the electrophotographic properties.

The resins which are useful for the second interlayer include water-soluble resins such as polyvinyl alcohol, polyvinyl methyl ether, polyvinylpyridine, polyacrylic acids, methylcellulose, ethylcellulose, polyglutamic acid, casein, gelatin, and starch; and resins such as polyamide resins, phenol resins, polyvinylformal, polyurethane elastomers, alkyd resins, ethylene-vinyl acetate copolymers, and vinylpyrrolidone-vinyl acetate copolymers. Among them, polyamide resins are preferred. The second interlayer has a thickness preferably in the range of from 0.1 to 5 μm, more preferably from 0.3 to 2 μm.

The photosensitive layer of the present invention includes monolayer type photosensitive layers which contain a charge-generating substance and a charge-transporting substance in one and the same layer, and lamination type photosensitive layers which are constituted from a charge-generating layer containing a charge-generating substance and a charge-transporting layer containing a charge-transporting substance.

As the charge-generating substance, employed are organic photoconductors such as pyrylium dyes, thiopyrylium dyes, phthalocyanine pigments, anthanthrone pigments, perylene pigments, dibenzopyrenequinone pigments, pyranthrone pigments, azo pigments, indigo pigments, quinacridone pigments, and the like.

As the charge-transporting substance, employed are organic photoconductors such as pyrazolines, hydrazones, stilbenes, triphenylamines, benzidines, oxazoles, indoles, carbazoles, and the like.

The monolayer type photosensitive layer can be formed by applicating a dispersion or solution of the charge-generating substance and the charge-transporting transporting substance in a suitable binder resin followed by drying. The thickness thereof is preferably in the range of from 5 to 40 μm, more preferably from 10 to 30 μm.

The lamination type photosensitive layer may be provided by firstly forming a charge-generating layer and then forming thereon a charge-transporting layer, or alternatively, by first forming a charge-transporting layer and then forming thereon a charge-generating layer. The charge-generating layer can be formed by applying and drying a dispersion of a charge-generating substance in a solution of a suitable binder resin. The thickness of the charge-generating layer is preferably not more than 5 μm, more preferably in the range of from 0.01 to 3 μm. The charge-transporting layer can be formed by applying and drying a solution of the aforementioned charge-transporting substance in a film-forming binder resin. The thickness of the charge-transporting layer is preferably in the range of from 5 to 40 μm, more particularly from 8 to 35 μm.

When the charge-generating layer is laminated on a charge-transporting layer, these layers can be formed by applying the aforementioned respective organic photoconductor and the binder resin followed by drying. In this case, preferably, the charge-generating layer also contains a charge-transporting substance.

These layers may be applied by a costing method such as immersion coating, spray coating, beam coating, roller coating, Meyer bar coating, blade coating, and so forth.

The electrophotographic photosensitive member of the present invention is applicable as the photosensitive member of various electrophotographic apparatus such as laser beam printers, LED printers, LCD printers, CRT printers, and facsimile machines as well as usual copying machines.

In Examples and Comparative Examples, the term "part" is based on weight.

EXAMPLE 1

A non-machined aluminum cylinder (30 mm diameter, 260 mm long, and 1 mm thick) was employed as the support. This aluminum cylinder was immersed in an aqueous 1% solution of a cleaning agent (Banraizu D-20, made by Tokiwa Kagaku K.K.), and was cleaned by means of a ultrasonic washer (600 W, 40 KHz) for one minute. This cylinder was rinsed with pure water, and then immersed in pure water having electric conductivity of 0.5 μS at 80° C. for one minute. Thereafter the cylinder was taken out and dried.

The work function (Ws) of the surface of this cylinder was measured to be 4.5 eV by a surface analyzing apparatus (AC-1, made by Riken Keiki Co., Ltd.).

A paint was prepared by dispersing 50 parts of powdery tin oxide, 50 parts of powdery rutile type titanium oxide, 40 parts of resol (trade name: Priophen J-325, made by Dainippon Ink and Chemicals, Inc.), 30 parts of methyl alcohol, and 30 parts of 2-methoxyethyl alcohol by means of a ball mill for 5 hours. The resulting paint was applied on the above cleaned aluminum cylinder by immersion coating, and was dried and cured at 150° C. for 30 minutes to give a film of 20 μm thick.

An interlayer of 0.2 μm thick was formed thereon by applying of a solution of 5 parts of methoxymethylated 6-nylon (Toresin, made by Teikoku Kagaku K.K.) in 50 parts of methanol and 45 parts of butanol.

Ten parts of the disazo pigment of the structural formula below:

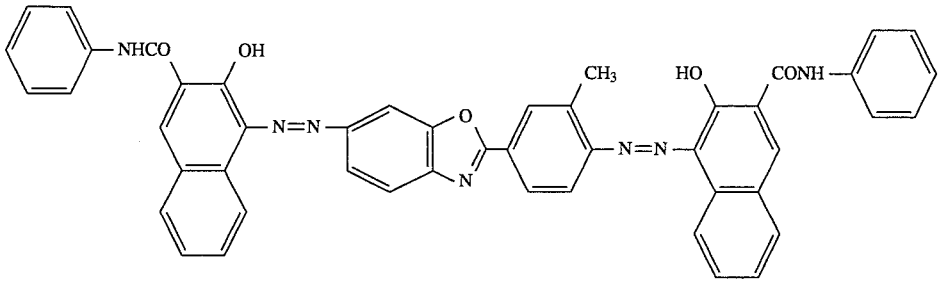

6 parts of cellulose acetate butyrate resin (trade name: CAB-381, made by Eastman Chemical Co.) were dispersed in 60 parts of cyclohexanone by a sand mill employing glass beads of 1 mm diameter for 20 hours. This liquid dispersion was diluted with 100 parts of methyl ethyl ketone, and the mixture was applied on the above interlayer by immersion coating, and was dried at 100° C. for 10 minutes to form a charge-generating layer.

Then, 10 parts of the hydrazone compound of the structural formula below:

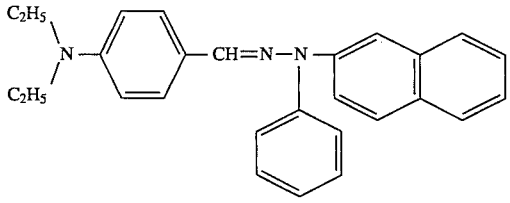

and 12 parts of a styrene-methyl methacrylate copolymer (trade name: MS-200, made by Seitetsu Kagaku K.K.) was dissolved in 70 parts of toluene. This solution was applied onto the above charge-generating layer and dried at 100° C. for 60 minutes to form a charge-transporting layer of 16 μm thick.

The resulting electrophotographic photosensitive member was mounted on a copying machine FC-3 made by Canon Inc. Copying was carried out under three environmental conditions, that is, high temperature and high humidity(32° C./85%); ordinary temperature and ordinary humidity(22° C./50%); and low temperature and low humidity(15° C./10%). As a result, excellent images were obtained under any of the above three environmental conditions.

The dark area potential ($V_D$) of the photosensitive member was measured at the respective environmental conditions under such charging conditions that a standard drum coated with a polyester film of 25 μm thick is charged to the potential of −700 V.

Then the photosensitive member was charged so that the dark area potential comes to be −600 V, and the quantity of light required to bring the light area potential ($V_L$) to −200 V was measured as the sensitivity. Further the potential immediately after the pre-exposure was measured as the residual potential ($V_R$).

The results are shown in Table 1.

COMPARATIVE EXAMPLE 1

An electrophotographic photosensitive member was prepared and evaluated in the same manner as in Example 1 except that aluminum cylinder as washed with trichloroethane in place of the aqueous solution and pure water, and that the interlayer containing the electroconductive substance was not provided.

The results are shown in Table 1.

COMPARATIVE EXAMPLE 2

An electrophotographic photosensitive member was prepared and evaluated in the same manner as in Example 1 except that the interlayer containing an electroconductive substance was not provided.

The results are shown in Table 1.

EXAMPLE 2

A machined aluminum cylinder (30 mm diameter, 346 mm long, and 1 mm thick) was cleaned and rinsed, and then treated with pure water in the same manner as in Example 1.

Rutile type titanium oxide coated with tin oxide and antimony oxide (10% by weight of tin oxide) in a coating amount of 75% by weight based on titanium oxide was prepared as the powdery electroconductive substance. Ten parts of this powdery electroconductive substance was mixed with 5 parts of a resol (trade name: Priophen 5010, made by Dainippon Ink and chemicals, Inc.), 8 parts of ethyl alcohol, and 6 parts of ethoxyethyl alcohol, and the mixture was dispersed by means of a ball mill for 6 hours.

The resulting paint was applied onto the above cleaned aluminum cylinder and dried and cured at 150° C. for 30 minutes to provide an interlayer of 20 μm thick of the present invention. Further a second interlayer which is the same as the one of Example 1 was formed on the above interlayer.

Then, 10 parts of the disazo pigment of the structural formula below as the charge-generating substance,

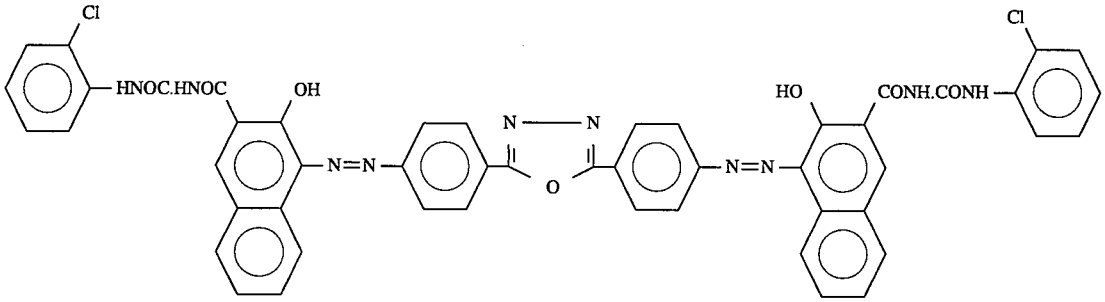

6 parts of a polyvinylbutyral resin (Eslec BX-1, made by Sekisui Chemical Co., Ltd.), and 50 parts of cyclohexanone were dispersed by means of a sand mill employing glass beads. This liquid dispersion was diluted with 100 parts of tetrahydrofuran, and was applied onto the above interlayer by immersion coating, and then dried to form a charge-generating layer.

Further on the charge-generating layer, a charge-transporting layer of 25 μm thick was prepared by applying a solution of 10 parts of the stilbene compound of the structural formula below:

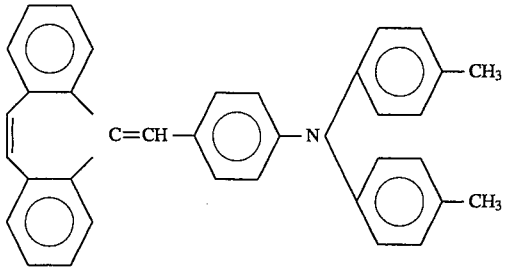

and 10 parts of a polycarbonate resin (Panlite L-1250, made by Teijin Kaset K.K.) in 50 parts of dichloromethane and 10 parts of monochlorobenzene by immersion coating.

The resulting photosensitive member was evaluated in the same manner as in Example 1 except that the copying machine was of Model NP 2020(Canon Inc.).

The results are shown in Table 2.

COMPARATIVE EXAMPLE 3

An electrophotographic photosensitive member was prepared and evaluated in the same manner as in Example 2 except that the aluminum cylinder was washed with trichloroethane in place of the aqueous solution and pure water and the interlayer of the present invention was not provided.

The results are shown in Table 2.

COMPARATIVE EXAMPLE 4

An electrophotographic photosensitive member was prepared and evaluated in the same manner as in Example 2 except that the interlayers containing electroconductive substances were not provided.

The results are shown in Table 2.

EXAMPLE 3

A machined aluminum cylinder (80 mm diameter, 360 mm long, and 1 mm thick) was employed as the support. This aluminum cylinder was immersed in an aqueous 5% (by weight) solution of a cleaning agent (Power Challenger, made by Neosu K.K.), and was cleaned by means of an ultrasonic washer (600 W, 40 KHz) for one minute. This cylinder was rinsed with pure water, and then immersed in pure water having electric conductivity of 0.1 μS at 80° C. for 3 minutes. The cylinder, fully washed, was taken out and dried.

The work function of the surface of this cylinder was measured in the same manner as in Example 1 and found to be 5.1 eV.

A paint was prepared by sufficiently mixing 3 parts of powdery tin oxide (T-10, made by Mitsubishi Metal Corporation), 8 parts of styrene-methyl acrylate copolymer, and 50 parts of toluene. The resulting paint was applied on the above cleaned aluminum cylinder by immersion coating, and was dried to form a film of 5 μm thick.

On this layer, a charge-generating layer and a charge-transporting layer were formed sequentially in the same manner as in Example 1.

The resulting photosensitive member was evaluated in the same manner as in Example 1 except that a copying machine used was of Model NP-3725 (made by Canon Inc.).

The results are shown in Table 3.

COMPARATIVE EXAMPLE 5

An electrophotographic photosensitive member was prepared and evaluated in the same manner as in Example 3 except that the cleaning and drying of the aluminum cylinder was washed with trichloroethane in place of the aqueous solution and pure water and the interlayer containing the electroconductive substance was not provided.

The results are shown in Table 3.

COMPARATIVE EXAMPLE 6

An electrophotographic photosensitive member was prepared and evaluated in the same manner as in Example 3 except that the interlayer containing the electroconductive substance was not provided.

The results are shown in Table 3.

As described above, the present invention provides an electrophotographic photosensitive member which exhibits excellent electrophotographic properties under any environmental conditions, produced by a process not giving harmful effects to the environment and the human health.

TABLE 1

| | Cleaning liquid | Inter-layer | $V_D$ (V) | Sensivity (lux.sec) | $V_R$ (V) | Image quality |
|---|---|---|---|---|---|---|
| Example 1 | Aqueous | Provided | −660 | 4.0 | −10 | Excellent |
| Comparative Example 1 | Trichloroethane | None | −630 | 4.0 | −20 | White spots at high temperature and high humidity |
| Comparative Example 2 | Aqueous | None | −620 | 3.9 | −10 | Irregularity of density at high temperature and high humidity |

TABLE 2

| | Cleaning liquid | Inter-layer | $V_D$ (V) | Sensivity (lux.sec) | $V_R$ (V) | Image quality |
|---|---|---|---|---|---|---|
| Example 2 | Aqueous | Provided | −665 | 3.1 | −10 | Excellent |
| Comparative Example 3 | Trichloroethane | None | −630 | 3.1 | −15 | White spots at high temperature and high humidity |
| Comparative Example 4 | Aqueous | None | −620 | 3.0 | −15 | Irregularity of density at high temperature and high humidity |

TABLE 3

| | Cleaning liquid | Inter-layer | $V_D$ (V) | Sensivity (lux.sec) | $V_R$ (V) | Image quality |
|---|---|---|---|---|---|---|
| Example 3 | Aqueous | Provided | −640 | 3.9 | −15 | Excellent |
| Comparative Example 5 | Trichloroethane | None | −610 | 4.0 | −25 | White spots at high temperature and high humidity |
| Comparative Example 6 | Aqueous | None | −600 | 3.9 | −15 | Irregularity of density at high temperature and high humidity |

What is claimed is:

1. An electrophotographic photosensitive member comprising:

an electroconductive support, an interlayer, and a photosensitive layer, the electroconductive support having been cleaned with a solution mainly composed of water sufficiently to remove contaminants and to form a non-uniform oxide film thereon, and the interlayer containing a resin and an electroconductive substance selected from the group consisting of metals, metal oxide and carbons dispersed therein.

2. An electrophotographic photosensitive member according to claim 1, wherein said electroconductive support is made of aluminum alloy.

3. An electrophotographic photosensitive member according to claim 1, wherein said solution contains a surfactant.

4. An electrophotographic photosensitive member according to claim 3, wherein said surfactant is an ionic type surfactant.

5. An electrophotographic photosensitive member according to claim 4, wherein said surfactant is selected from the group consisting of aliphatic higher alcohol sulfate ester sodium salts, alkyltrimethylammonium chlorides, and alkyldimethyl betaine.

6. An electrophotographic photosensitive member according to claim 3, wherein said surfactant is a nonionic type.

7. An electrophotographic photosensitive member according to claim 6, wherein said surfactant is an aliphatic higher alcohol-ethylene oxide adduct.

8. An electrophotographic photosensitive member according to claim 3, wherein said surfactant is mildly acidic to alkaline.

9. An electrophotographic photosensitive member according to claim 1, wherein the specific resistivity is 0.1 MΩ.

10. An electrophotographic photosensitive member according to claim 1, wherein washing is carried out at 25° to 80° C.

11. An electrophotographic photosensitive member according to claim 1, wherein ultrasonication is applied to the solution.

12. An electrophotographic photosensitive member according to claim 1, wherein washing is carried out plural times.

13. An electrophotographic photosensitive member according to claim 1, wherein the surface of the electroconductive support is treated with steam of pure water after the washing.

14. An electrophotographic photosensitive member according to claim 1, wherein after the washing, the surface of the electroconductive support is immersed in hot pure water and then pulled up.

15. An electrophotographic photosensitive member according to claim 13, wherein the electric conductivity of said hot pure water is 5 μS or less.

16. An electrophotographic photosensitive member according to claim 14, wherein the electric conductivity of said hot pure water is 1 μS or less.

17. An electrophotographic photosensitive member according to claim 13, wherein the temperature of said hot pure water is 25° to 90° C.

18. An electrophotographic photosensitive member according to claim 16, wherein the temperature of said hot pure water is 40° to 80° C.

19. An electrophotographic photosensitive member according to claim 13, wherein ultrasonication is applied to the washing solution.

20. An electrophotographic photosensitive member according to claim 1, wherein after the washing, the surface of the electroconductive support is showered with pure water and then dried with hot air.

21. An electrophotographic photosensitive member according to claim 1, wherein said electroconductive substance is a metal oxide.

22. An electrophotographic photosensitive member according to claim 1, wherein said resin is a thermosetting resin.

23. An electrophotographic photosensitive member according to claim 22, wherein said resin is a phenol resin.

24. An electrophotographic photosensitive member according to claim 23, wherein the ratio of said electroconductive substance and said resin is 5:1 to 1:1.

25. An electrophotographic photosensitive member according to claim 1, wherein the thickness of said interlayer is 1 to 30 μm.

26. An electrophotographic photosensitive member according to claim 25, wherein the thickness of said interlayer is 5 to 25 μm.

27. An electrophotographic photosensitive member according to claim 1, comprising a second interlayer between said interlayer and said photosensitive layer.

28. An electrophotographic photosensitive member according to claim 27, wherein the thickness of said second interlayer is 0.1 to 5 μm.

29. An electrophotographic photosensitive member according to claim 27, wherein the thickness of said second interlayer is 0.3 to 2 μm.

30. An electrophotographic photosensitive member according to claim 1, wherein said photosensitive layer comprises a charge generating layer and a charge transporting layer.

31. An electrophotographic photosensitive member according to claim 30, wherein said photosensitive layer comprises a charge generating layer and a charge transporting layer formed in this order.

32. An electrophotographic photosensitive member according to claim 30, wherein said photosensitive layer comprises a charge transporting layer and a charge generating layer formed in this order.

33. A process for producing an electrophotographic photosensitive member, comprising:

(1) a step of washing the surface of a contaminated electroconductive support with a solution mainly consisting of water sufficiently to remove said contaminants and to form a non-uniform oxide film thereon;

(2) a step of forming an interlayer containing a resin and an electroconductive substance selected from the group consisting of metals, metal oxides and carbons dispersed therein on the washed and oxidized surface of said electroconductive support; and (3) a step of forming a photosensitive layer on said interlayer.

34. A process for producing an electrophotographic photosensitive member according to claim 33, wherein said electroconductive support is made of aluminum alloy.

35. A process for producing an electrophotographic photosensitive member according to claim 33, wherein said solution contains a surfactant.

36. A process for producing an electrophotographic photosensitive member according to claim 35, wherein said surfactant is an ionic type surfactant.

37. A process for producing an electrophotographic photosensitive member according to claim 36, wherein said surfactant is selected from the group consisting of aliphatic higher alcohol sulfate ester sodium salts, alkyltrimethylammonium chlorides, and alkyldimethyl betaine.

38. A process for producing an electrophotographic photosensitive member according to claim 35, wherein said surfactant is a nonionic type.

39. A process for producing an electrophotographic photosensitive member according to claim 38, wherein said surfactant is an aliphatic higher alcohol-ethylene oxide adduct.

40. A process for producing an electrophotographic photosensitive member according claim 35, wherein said surfactant is mildly acidic to alkaline.

41. A process for producing an electrophotographic photosensitive member according to claim 33, wherein the specific resistivity is 0.1 MΩ.

42. A process for producing an electrophotographic photosensitive member according to claim 33, wherein washing is carried out at 25° to 80° C.

43. A process for producing an electrophotographic photosensitive member according to claim 33, wherein ultrasonication is applied to the solution.

44. A process for producing an electrophotographic photosensitive member according to claim 33, wherein washing is carried out plural times.

45. A process for producing an electrophotographic photosensitive member according to claim 33, wherein the surface of the electroconductive support is treated with steam of pure water after the washing.

46. A process for producing an electrophotographic photosensitive member according to claim 33, wherein after the washing, the surface of the electroconductive support is immersed in hot pure water and then pulled up.

47. A process for producing an electrophotographic photosensitive member according to claim 45, wherein the electric conductivity of said hot pure water is 5 μS or less.

48. A process for producing an electrophotographic photosensitive member according to claim 46, wherein the electric conductivity of said hot pure water is 1 μS or less.

49. A process for producing an electrophotographic photosensitive member according to claim 45, wherein the temperature of said hot pure water is 25° to 90° C.

50. A process for producing an electrophotographic photosensitive member according to claim 48, wherein the temperature of said hot pure water is 40° to 80° C.

51. A process for producing an electrophotographic photosensitive member according to claim 45, wherein ultrasonication is applied to the washing solution.

52. A process for producing an electrophotographic photosensitive member according to claim 33, wherein after the washing, the surface of the electroconductive support is showered with pure water and then dried with hot air.

53. A process for producing an electrophotographic photosensitive member according to claim 33, wherein said electroconductive substance is a metal oxide.

54. A process for producing an electrophotographic photosensitive member according to claim 33, wherein said resin is a thermosetting resin.

55. A process for producing an electrophotographic photosensitive member according to claim 54, wherein said resin is a phenol resin.

56. A process for producing an electrophotographic photosensitive member according to claim 33, wherein the ratio of said electroconductive substance and said resin is 5:1 to 1:1.

57. A process for producing an electrophotographic photosensitive member according to claim 33, wherein the thickness of said interlayer is 1 to 30 μm.

58. A process for producing an electrophotographic photosensitive member according to claim 57, wherein the thickness of said interlayer is 5 to 25 μm.

59. A process for producing an electrophotographic photosensitive member according to claim 33, comprising a second interlayer between said interlayer and said photosensitive layer.

60. A process for producing an electrophotographic photosensitive member according to claim 59, wherein the thickness of said second interlayer is 0.1 to 5 μm.

61. A process for producing an electrophotographic photosensitive member according to claim 60, wherein the thickness of said second interlayer is 0.3 to 2 μm.

62. A process for producing an electrophotographic photosensitive member according to claim 33, wherein said photosensitive layer comprises a charge generating layer and a charge transporting layer.

63. A process for producing an electrophotographic photosensitive member according to claim 62, wherein said photosensitive layer comprises a charge generating layer and a charge transporting layer formed in this order.

64. A process for producing an electrophotographic photosensitive member according to claim 62, wherein said photosensitive layer comprises a charge transporting layer and a charge generating layer formed in this order.

* * * * *

UNITED STATES PATENT AND TRADEMARK OFFICE

CERTIFICATE OF CORRECTION

PATENT NO. : 5,561,015

DATED : October 1, 1996

INVENTOR(S) : AKIRA YOSHIDA ET AL.

It is certified that error appears in the above-identified patent and that said Letters Patent is hereby corrected as shown below:

[57] ABSTRACT

Line 5, "end" should read --and--.

COLUMN 1

Line 28, "support,is" should read --support is --;
Line 33, "fingerprint," should read --fingerprints--;
Line 45, "are" should read --were--.

COLUMN 2

Line 3, Delete "the";
Line 5, "toughened," should read --roughened,--;
Line 51, "metal or alloy" should read --metals or alloys--;
Line 53, "workability dimensional" should read --workability and dimensional--.

COLUMN 3

Line 13, "25" should read --25°C--;
Line 17, "into" should read --in--;
Line 27, Delete "a".

UNITED STATES PATENT AND TRADEMARK OFFICE

CERTIFICATE OF CORRECTION

PATENT NO. : 5,561,015

DATED : October 1, 1996

INVENTOR(S) : AKIRA YOSHIDA ET AL.

It is certified that error appears in the above-identified patent and that said Letters Patent is hereby corrected as shown below:

COLUMN 4

Line 21, Delete "a". (second occurrence)

COLUMN 5

Line 3, Delete "transporting" (2nd occurrence);
Line 42, "costing" should read --coating--.

COLUMN 6

Line 11, Delete "of" (1st occurrence).

COLUMN 7

Line 4, "Further the" should read --Further, the--;
Line 12, "as" should read --was--;
Line 38, "chemicals," should read --Chemicals;--

Line 44, "Further a" should read --Further, a--.

COLUMN 8

Line 4, "Further on" should read -- Further, on--.

UNITED STATES PATENT AND TRADEMARK OFFICE

CERTIFICATE OF CORRECTION

PATENT NO. : 5,561,015

DATED : October 1, 1996

INVENTOR(S) : AKIRA YOSHIDA ET AL.

It is certified that error appears in the above-identified patent and that said Letters Patent is hereby corrected as shown below:

COLUMN 11

Line 10, "oxide" should read --oxides--.

Signed and Sealed this

Twenty-ninth Day of April, 1997

*Attest:*

Bruce Lehman

BRUCE LEHMAN

*Attesting Officer*

*Commissioner of Patents and Trademarks*